United States Patent [19]

Scott

[11] 4,186,287

[45] Jan. 29, 1980

[54] SWITCH OPERATING ASSEMBLY INCLUDING A SELF-ADJUSTING ARRANGEMENT

[75] Inventor: Allen W. Scott, Louisville, Ky.

[73] Assignee: General Electric Company, Louisville, Ky.

[21] Appl. No.: 918,176

[22] Filed: Jun. 22, 1978

[51] Int. Cl.[2] ..... H01H 3/16

[52] U.S. Cl. ..... 200/61.62; 200/61.41; 200/61.64; 200/61.72; 200/153 T; 200/332

[58] Field of Search ..... 200/61.23, 61.24, 61.41, 200/61.42, 61.44, 61.62, 61.64, 61.65, 61.67, 61.71–61.76, 153 T, 329, 332, 335; 134/58 D, 58 DL

[56] References Cited

U.S. PATENT DOCUMENTS

| | | | |
|---|---|---|---|
| 2,759,485 | 8/1956 | Guth | 200/61.62 X |
| 2,770,697 | 11/1956 | Kellett | 335/205 |
| 3,005,065 | 10/1961 | Jellies | 200/61.62 |
| 3,176,093 | 3/1965 | Pollak et al. | 200/61.62 |
| 3,553,448 | 1/1971 | Davis et al. | 362/80 |
| 3,594,519 | 7/1971 | Schmidlin | 200/61.41 |
| 3,718,785 | 2/1973 | Kudritzki | 200/61.41 |
| 3,755,642 | 8/1973 | Warner | 200/153 T X |
| 3,928,739 | 12/1975 | Miyamae | 200/155 R |

FOREIGN PATENT DOCUMENTS

| | | | |
|---|---|---|---|
| 440000 | 12/1967 | Switzerland | 200/153 T |

*Primary Examiner*—James R. Scott

*Attorney, Agent, or Firm*—H. Neil Houser; Radford M. Reams

[57] ABSTRACT

An interlock switch comprises a standard snap action switch, provided with an actuating leaf, coiled at one end and fixed to the switch housing at the other end. In one application the switch is to be actuated by a door latch handle which passes between an open and a closed position by engaging the coiled actuating leaf. The leaf is initially coiled such that the coil is engaged by the latch handle early in its travel. When the latch handle is closed for the first time, the coil is unrolled to a closed coil position at the closed position of the latch handle. When the latch handle returns to the open positon, the coil re-rolls only slightly to a new open coil position displaced a short distance from the closed coil position. The coil is thus positioned so that in subsequent latch handle closings, the coil is not engaged until the latch handle approaches the closed position.

6 Claims, 9 Drawing Figures

SWITCH OPERATING ASSEMBLY INCLUDING A SELF-ADJUSTING ARRANGEMENT

BACKGROUND OF THE INVENTION

In some home appliances it is desirable to insure that the appliance operates only when the door is tightly closed. This is commonly accomplished by providing a normally open switch and a switch actuating member in combination such that the actuating member engages and closes the switch only when the door is tightly closed. Spacing tolerances between the switch and the actuating member become particularly critical for appliances such as dishwashers because, if the switch is engaged before the door is completely closed or fails to disengage before the door is partially opened, hot water may spray out around the door. Alternatively, the switch may not be engaged even though the door is tightly closed in which case the appliance will not operate at all. Thus, it is desirable to provide an inexpensive switch which will reliably enable appliance operation only when the door is tightly closed without requiring a precision switch with the attendant tighter manufacturing tolerances and increased cost.

It is therefore an object of this invention to provide a relatively simple, reliable and inexpensive interlock switch.

It is a further object of the invention to provide a relatively simple, reliable, inexpensive interlock switch without requiring unduly restrictive manufacturing tolerances in the manufacture of the switch and the assembly of the switch and latch combination with attendant increased manufacturing costs.

SUMMARY OF THE INVENTION

In accordance with this invention an interlock switch for insuring that an appliance operates only when the appliance door is tightly closed comprises a standard snap action switch having a housing, and a pushbutton slidably mounted in said housing for closing said switch when depressed. The switch further includes a deformable actuating leaf mounted at one end to the housing and having a free end extending over the pushbutton for engagement therewith. A reconfigurable coil is formed at the free end of the actuating leaf. The reconfigurable coil provides a self-adjusting capability which enables the switch to automatically compensate for manufacturing tolerances which affect the relative positions of the switch and a switch-actuating body.

In one application of the invention the switch is actuated by a door latch handle which moves between an open position corresponding to an unlatched door condition and a closed position corresponding to a latched door condition. This door latch handle is mounted on the door of the appliance. The interlock switch is positioned on the appliance door such that as the door is latched the handle engages the coil in moving from its open to its closed position tending to unroll the coil, thereby urging the leaf to depress the pushbutton.

On its initial pass, from open to closed, the handle engages the coil relatively early in its travel causing the pushbutton to be depressed prematurely. Having engaged the coil, the handle continues to travel to its closed position unrolling the coil and stressing the coil beyond its elastic limit. When the handle is returned to its open position, the coil, having been stressed beyond its elastic limit, re-rolls only slightly to a position displaced a short distance from the closed position of the handle. Thus, on all passes of the handle from its open to its closed position subsequent to the initial pass, the coil is engaged by the handle only as the handle closely approaches its closed position. This self-adjusting feature of the invention provides an inexpensive switch which will reliably enable appliance operation only when the door is tightly closed without requiring a precision switch and precision assembly procedures with the attendant tighter manufacturing tolerances and increased cost.

A full understanding of the invention may be had by a study of the drawings and detailed description which follow.

DETAILED DESCRIPTION OF THE INVENTION

Figure 1:
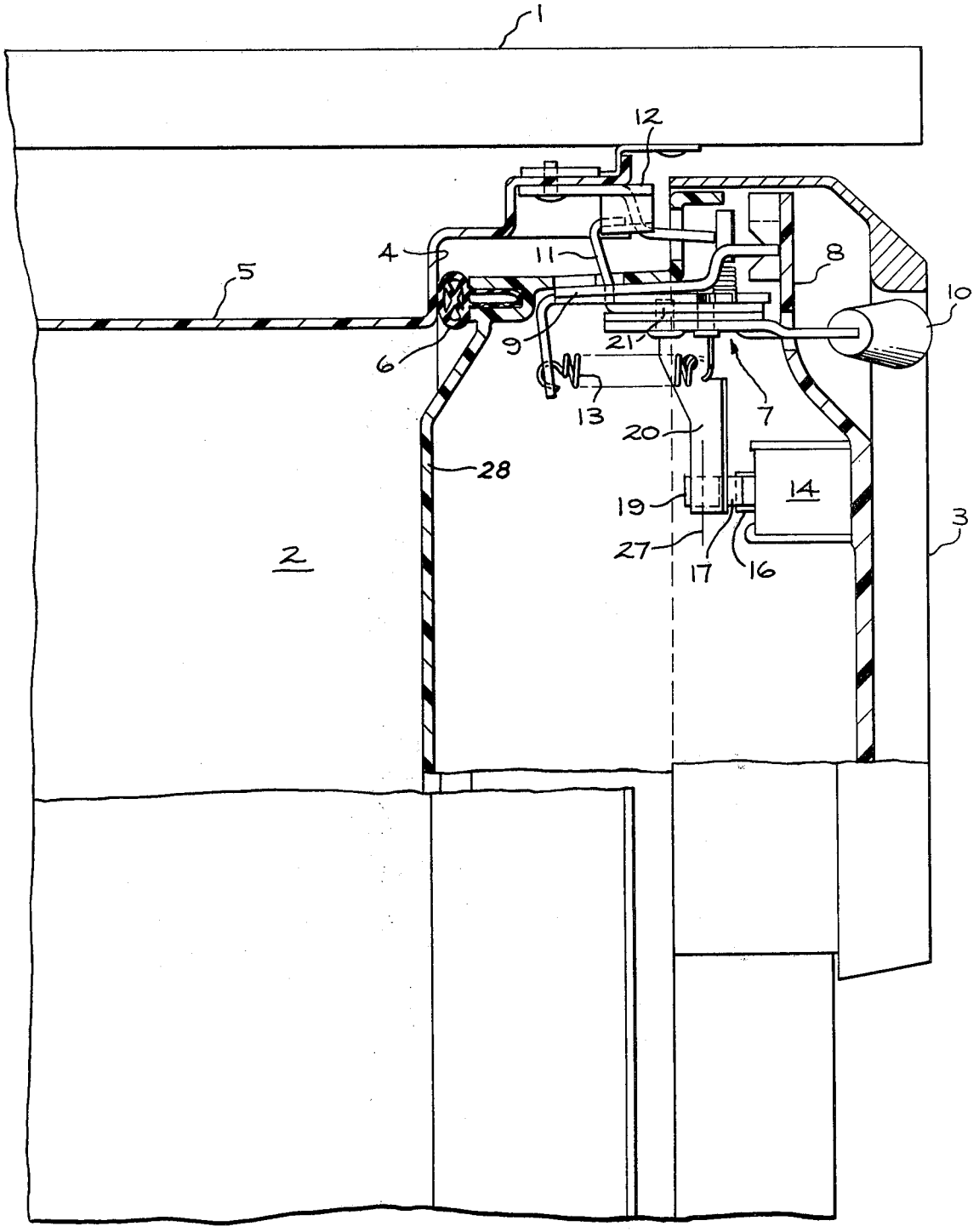
FIG. 1 is a side view of a portion of the dishwasher cut away to show the switch and the latch employed in one embodiment of the invention.

The structure of this invention is useful generally in a switch operating assembly for insuring that a switch is actuated at a relatively precise point in the stroke of a reciprocating switch-actuating means. In one application of the invention the switch is used as an interlock employed in an automatic dishwasher to insure that the dishwasher operates only when the dishwasher door is tightly closed. In such an application the switch-actuating means is a manually operable latch handle extending from a latch for locking the door of the dishwasher tightly closed. The latch handle is pivoted at one end and moves in an arcuate path between an open or unlatched and a closed or latched position to unlock and lock the dishwasher door, respectively. The handle actuates the switch as the handle closely approaches its closed position, thereby insuring that the dishwasher operates only when the door is latched.

In order to facilitate a thorough understanding of this invention, it will be described in a dishwasher environment, shown in FIGS. 1–4, in which it is particularly useful.

In FIGS. 1–4, there is shown a portion of a dishwasher which includes a cabinet 1 which provides a compartment 2 for receiving dishes to be washed. The cabinet 1 has a front access opening which is closed by a door 3. The door 3 in its closed position is arranged to abut a face 4 of the liner 5 of the compartment 2. A gasket 6 is positioned between the face 4 and the the door 3 to provide sealing engagement.

It is important that the door 3 be held firmly closed to seal the compartment 2 when the dishwasher is in operation to insure against leakage of water. For this purpose it is customary to provide a door latch indicated generally by the numeral 7. Since the details of the latch do not form a part of the present invention, the latch will be described only to the extent necessary to an understanding of its relationship to the operation of the switch.

Figure 2:
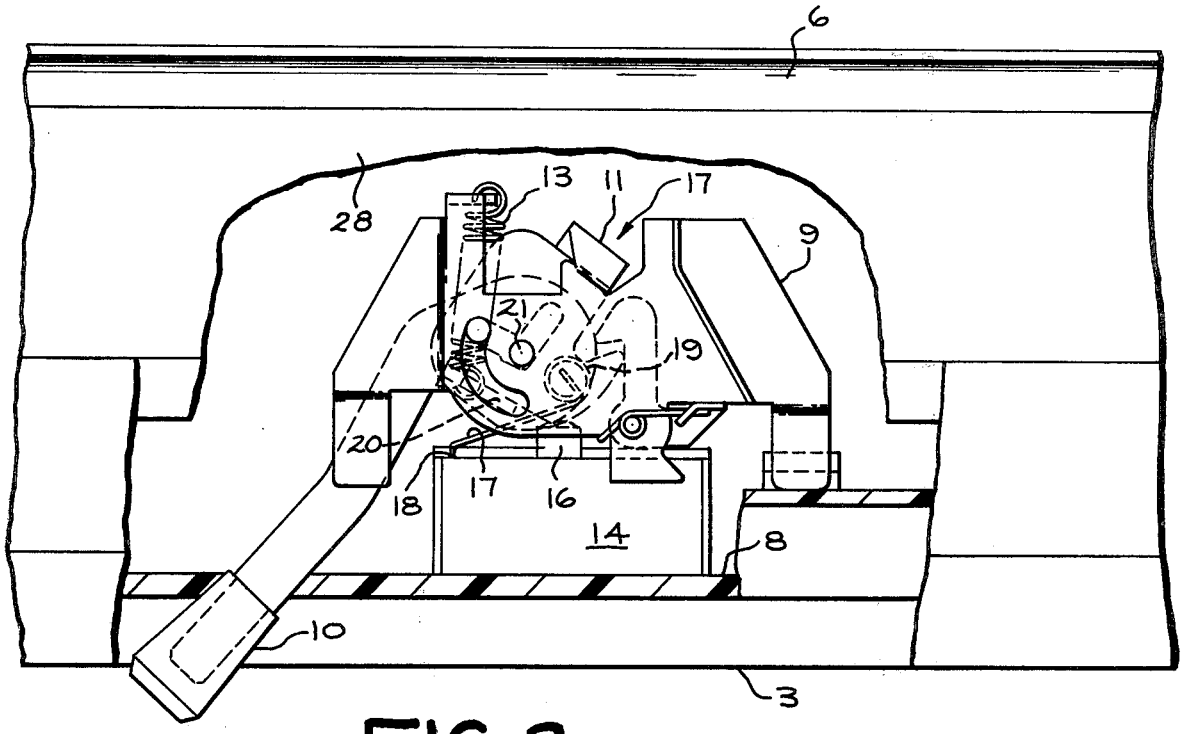
FIGS. 2, 3 and 4 are top views of the cutaway portion of the dishwasher of FIG. 1 showing the switch engaged by the latch, in open, partially closed and fully closed positions, respectively.
Figure 4:
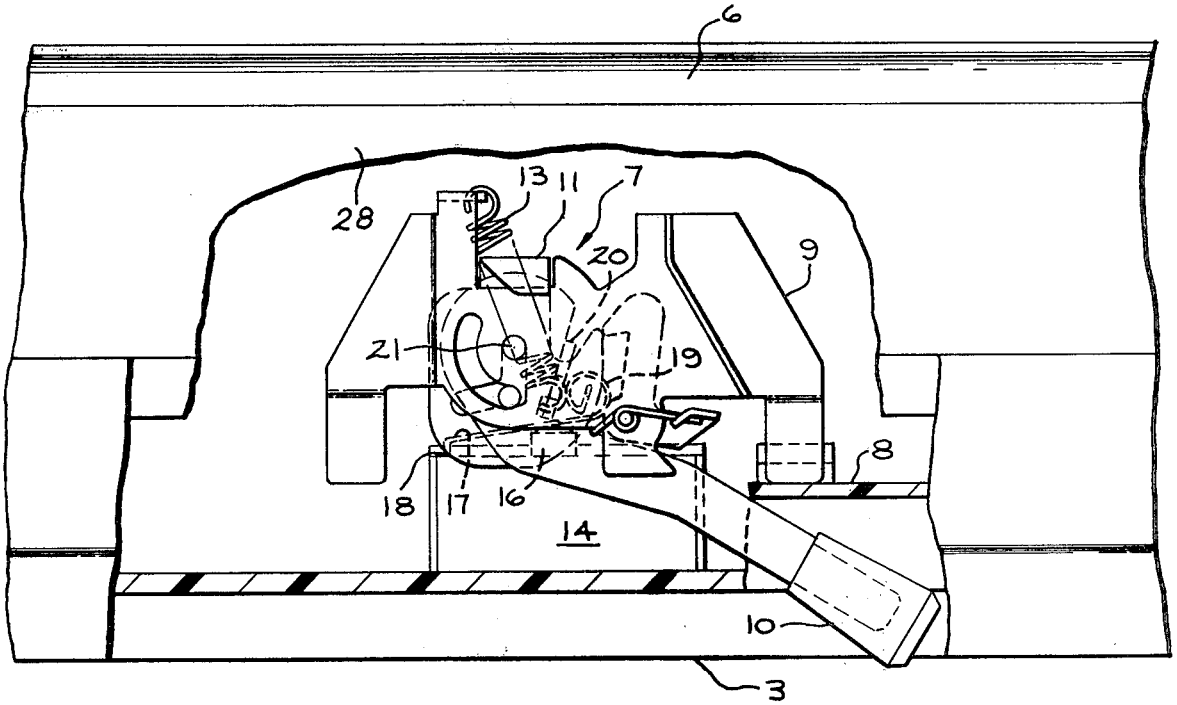

In the embodiment shown, a latch frame 9 is mounted to the interior panel 28 of the door 3. A manually operable latch handle 10 is pivotally mounted to the frame 9, and extends through a slot in the door. To latch the door 3, the latch handle 10 is rotated approximately 90° in a counterclockwise direction from its open or unlatched position as shown in FIG. 2 to its closed or latched position as shown in FIG. 4. This causes a tab 11 to engage the latch keeper 12, mounted on the liner 5, and urge the door against the door gasket 6. The latch handle 10 is biased in its open and closed positions by an overcenter spring 13. To unlatch the door, the latch handle 10 is simply manually rotated in a clockwise direction back to its open position.

Figure 5:
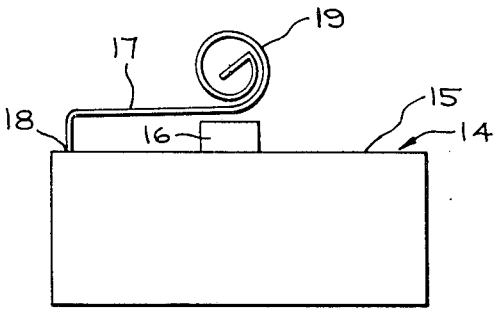
FIG. 5 is a top view of an embodiment of the switch of this invention.

The switch of this invention, indicated generally at 14 is mounted on the control panel 8 of the door 3. Referring now to FIG. 5, the switch includes a housing 15 within which is incorporated a standard snap action mechanism which includes a pushbutton 16 projecting through an opening in the housing. Since any of a number of commercially available snap action mechanisms may be employed and since the details thereof are not part of the invention, the snap action mechanism has not been shown. The switch 14 is provided with an actuating leaf 17 fixed at one end 18 to the switch housing 15 and configured into a coil 19 at its free end. The actuating leaf 17 extends from its fixed end 18 over the projecting portion of the pushbutton 16. In its initial configuration, the coil 19 assumes an initial position over a portion of the projecting pushbutton 16. In the dishwasher application of FIGS. 1–4, the switch housing 15 is positioned such that the coil 19 lies in the arcuate path of a latch handle extension 20 (best shown in FIG. 1) which extends downward from the latch handle 10, for engaging the coil 19.

In operation, the coil 19 is engaged by the extension 20 in such a manner that the coil 19 is partially unrolled. This unrolling of the coil 19 urges the actuating leaf 17 against the pushbutton 16 thereby depressing the pushbutton 16 and actuating the switch 14. It is essential that as the coil is unrolled, it is stressed beyond its elastic limit and thus re-rolls only slightly upon disengagement from said switch-actuating means. This aspect of the invention is later discussed in greater detail.

Figure 6:
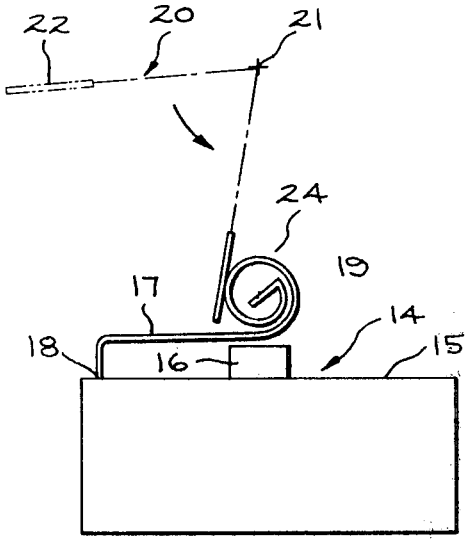
FIG. 6 is a top view of the switch showing the coil in its initial position initially engaged by the latch handle.
Figure 7:
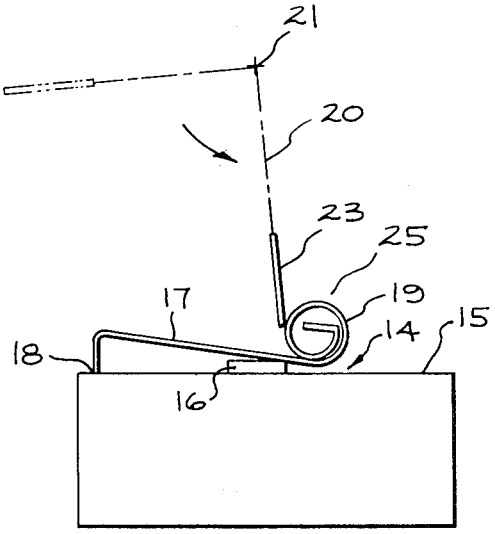
FIG. 7 is a top view of the switch showing the coil engaged by the latch handle in its closed (switch-actuated) position.
Figure 8:
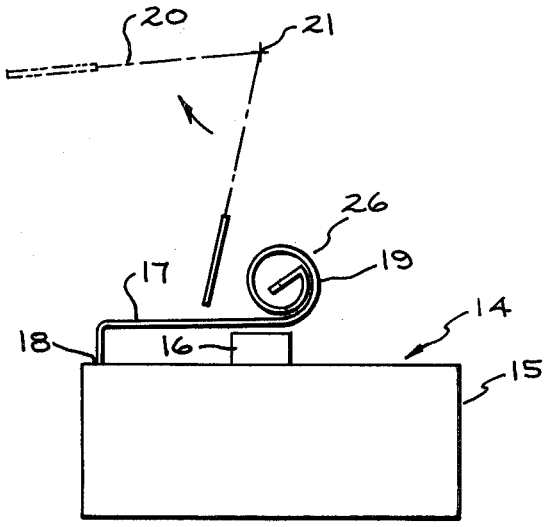
FIG. 8 is a top view of the switch showing the coil in its open position after disengagement from the latch handle.

FIGS. 6–8 illustrate the various positions assumed by the coil 19 as it moves in response to the movement of the latch handle 10 which includes the latch handle extension 20. The latch handle 10 and latch handle extension 20 are represented schematically in these figures.

The extension 20 of FIGS. 6–8 moves with the handle 10 which is pivoted at 21. The extension 20 thus moves in an arcuate path between an open position designated 22 in FIG. 6 corresponding to the unlatched position of the latch handle 10 (as shown in FIG. 2) and a closed position designated 23 in FIG. 7 corresponding to the latched position of the latch handle (as shown in FIG. 4). As illustrated schematically in FIGS. 6–8, movement of the latch handle 10 from open to closed position causes the coil 19 to be unrolled. As the coil 19 is unrolled it is urged against the pushbutton 16 thereby actuating the switch 14. As illustrated in FIG. 6, on the first pass of the handle 10 from open to closed, the extension 20 engages the coil 19 early in its travel at an initial coil position designated 24 and unrolls the coil 19 to a closed coil position 25 (See FIG. 7) corresponding to the closed position 23 of the latch handle 10. Engagement of the coil 19 by the extension 20 urges the actuating leaf 17 against the pushbutton 16 causing the pushbutton 16 to be depressed, thereby actuating the normally open snap action mechanism enclosed in the switch housing 14.

When the latch handle 10 is moved back to its open position after the initial movement to its closed position, the coil 19 re-rolls to a position shown at 26 in FIG. 8 which will be hereinafter referred to as the open coil position. As illustrated in FIG. 8 and more clearly in FIG. 9, the coil 19 rerolls only sightly to the open coil position 26 which is displaced a short distance from the closed coil position 25. On all passes of the handle 10 subsequent to the first pass, the coil 19 will be engaged by the extension 20 at the open coil position 26 rather than the initial coil position 24. Since this position is displaced only a short distance from the closed coil position 25, the structure of the invention insures that the switch will not be actuated until the latch handle closely approaches its latched position, regardless of variations in the relative positioning of the switch and the latch or even in the initial coil position relative to the pushbutton, which may result from normal manufacturing tolerances.

While in the preferred embodiment the latch handle extension 20 follows an arcuate path, it is apparent from FIGS. 6–8 that this path is approximately perpendicular to both the path of the pushbutton 16 and the centerline of the coil (designated 27 in FIG. 1,) in the vicinity of the coil. It is further apparent that for effective switch actuation in accordance with this invention the switch actuating body could follow other paths provided that the path be approximately perpendicular to both the path of the pushbutton and the centerline of the coil in the vicinity of the coil.

Figure 9:
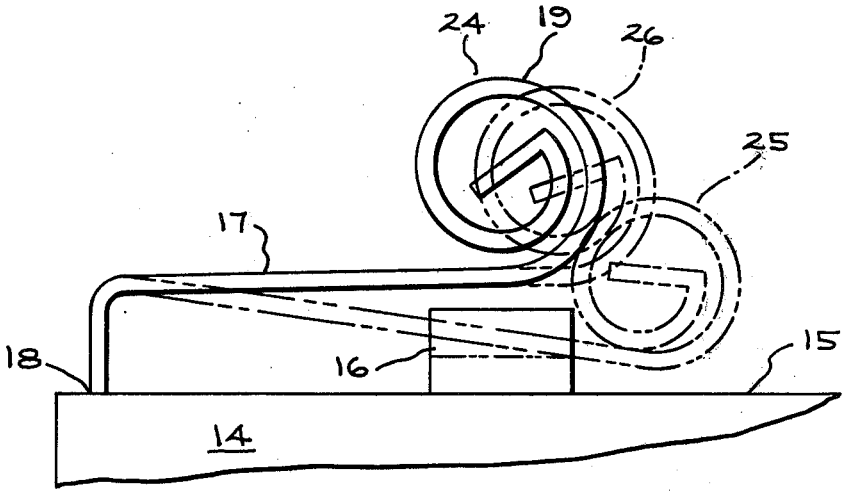
FIG. 9 is a top view showing the coil positions of FIGS. 6 through 8 superimposed in one view for illustrative purposes.

FIG. 9 shows the three coil positions, initial 24, closed 25, and open 26, superimposed to illustrate the relationship of the three positions and particularly the relative proximity of the open and closed positions 26 and 25, respectively. It is apparent from FIG. 9 that the open and closed coil positions 26 and 25 are in close proximity. This is due to the fact that the coil 19 re-rolls only slightly upon disengagement from the latch handle extension 20, the coil 19 having been stressed beyond its elastic limit as it was unrolled. It is this slight re-rolling which provides the desired tolerance compensation. If the coil re-rolled substantially to a position relatively remote from the closed coil position, the switch could be actuated prematurely during subsequent closings of the latch. If the coil did not re-roll at all, the latch handle extension 20 could engage the coil too close to the closed latch handle position and thereby fail to move the coil enough to depress the pushbutton. By providing a coil which re-rolls only slightly to an open coil position displaced a short distance from the closed coil position, an open coil position is established by the initial closing of the latch handle which insures actuation of the switch only as the latch handle closely approaches its closed position on all subsequent closings.

This is true regardless of variations in the position of the latch relative to the switch and of the initial position of the coil relative to the pushbutton due to normal manufacturing tolerances. Thus within normal manufacturing tolerances a wide latitude in the construction of the switch and in the positioning of the switch relative to the latch during assembly is permitted and precision tolerances and assembly procedures which increase manufacturing costs are avoided.

Figure 3:
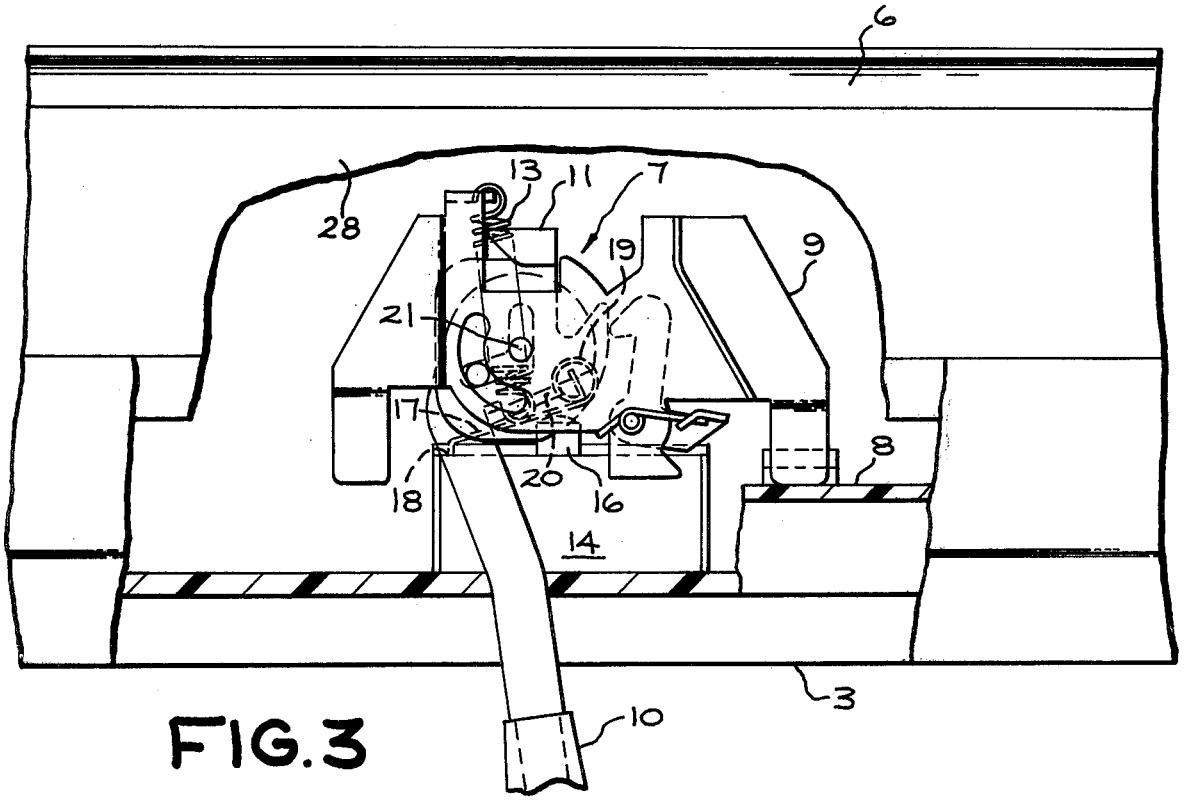

The operation of the dishwasher embodiment is as follows: On the first closing of the door latch, the latch handle extension 20 engages the coil 19 early in its travel as shown in FIG. 3. As the latch handle 10 reaches its latched position, the handle extension 20 has unrolled the coil 19 to its closed coil position 25. When the latch handle 10 is returned to its unlatched position to unlock the door 3, the coil 19 re-rolls slightly becoming disengaged from said extension 20 upon reaching its open coil position 26. On all subsequent closings of the door latch 7 the latch handle extension 20 engages the coil 19 at this open coil position, which is closely adjacent the closed coil position, thereby insuring that the switch is actuated only as the latch handle closely approaches its latched position and therefore insuring that the door is tightly latched closed before the dishwashing mechanism begins to operate. It will be understood that the initial closing of the door latch is performed in the factory as part of the manufacturing process so that when the appliance is supplied to the user the switch will be actuated only as the latch handle closely approaches its closed position.

In the preferred embodiment the actuating leaf 17, including the coil 19, is constructed from a strip of $\frac{3}{4}$ hard stainless steel, AISI #302, having a nominal cross-section width of 0.25 inch and thickness of 0.015 inch. The leaf 17 and coil 19 could be made of other materials provided only that the moment generated about the fixed end of the leaf by the unrolling of the coil exceeds the moment required to depress the pushbutton and that the material is stressed beyond its elastic limit when unrolled. When a force sufficient to unroll the coil is applied to the coil by an actuating body, a moment is generated about the fixed end approximately equal to the yield strength of the leaf in bending. Thus, yield stress of the material and the cross-section of the leaf must combine to provide a moment sufficient to overcome the opposing moment generated by the force of the pushbutton acting at a predetermined distance from the fixed end of the leaf.

While the invention has been described in connection with an automatic dishwasher with which it is particularly useful, it will be apparent to those skilled in the art that this invention may be applied to other structures in which it is desirable that a switch be actuated at a relatively precise point in the stroke of a reciprocating body or other movable member. Any device utilizing a motion which is approximately perpendicular to the path of the pushbutton and the centerline of the coil in the vicinity of the coil would enable the switch of this invention to function effectively and would be within the scope of this invention.

Other modifications and alterations of this invention will become apparent to those skilled in the art from the foregoing discussion, and it should be understood that this invention is not limited to the specific structure disclosed. It is intended to cover by the following claims all modifications coming within the spirit and scope thereof.

What is claimed is:

1. A switch operating assembly comprising:

a switch including a housing;

a pushbutton slidably mounted in said housing and projecting therefrom for actuating said switch;

a deformable switch actuating leaf attached at one end to said housing and having a free end extending over said pushbutton for engagement therewith;

said leaf including at its free end a reconfigurable coil;

a switch actuating means arranged to engage said coil in moving from a first to a second position for urging said leaf against said pushbutton to actuate said switch;

said switch-actuating means engaging said coil during its initial movement from said first to said second position to cause said coil to partially unroll, said coil re-rolling to an open coil position displaced a short distance from the closed position of said switch-actuating means and disengaging from said switch-actuating means as said switch-actuating means returns to said first position, said coil being thereby disposed for subsequent engagement by said switch-actuating means only when said switch-actuating means closely approaches its second position.

2. The swtich operating assembly of claim 1, wherein said switch-actuating means, in moving from said first to said second position, stresses said coil beyond its elastic limit, thereby limiting the re-rolling of said coil to said short distance upon the return said switch-actuating means to said first position.

3. The switch operating assembly of claim 2, wherein movement of said switch-actuating means follows a path approximately perpendicular to a path of the pushbutton and the centerline of the coil.

4. The switch operating assembly of claim 2, wherein said switch-actuating means comprises member pivoted at one end and having a free end for engaging said coil, said free end swinging in an arcuate path in moving from said first to said second position, said coil being disposed in said arcuate path for engagement by said lever.

5. A dishwasher door latching and control arrangement for enabling operation of the dishwasher only when the dishwasher door is tightly closed, comprising:

a door;

a latch mounted on said door;

said latch including a handle movable between an open position corresponding to an unlatched door condition and a closed position corresponding to a latched door condition;

a switch mounted on said door;

said switch including a housing and a pushbutton slidably mounted in said housing and projecting therefrom for actuating said switch;

a deformable switch-actuating leaf attached at one end of said housing and having a free end extending over said pushbutton for engagement therewith;

said leaf including at its free end a reconfigurable coil;

said handle being disposed so as to engage said coil in moving from said open to said closed position for urging said leaf against said pushbutton to actuate said switch;

said handle engaging said coil during its initial movement from said open to said closed position to cause said coil to partially unroll, said coil re-rolling to an open coil position displaced a short distance from the closed position of said handle and disengaging from said handle as said handle returns to said open position, said coil being thereby disposed for subsequent engagement by said handle only when said handle closely approaches said closed position.

6. The dishwasher door latching and control arrangement of claim 5, wherein said handle, in moving from said open to said closed position, stresses said coil beyond its elastic limit, thereby limiting the re-rolling of said coil to said short distance upon the return of said handle to said open position.

* * * * *